United States Patent [19]

Briggs

[11] 3,940,117

[45] Feb. 24, 1976

[54] AGITATING APPARATUS

[75] Inventor: Charles Jonathan Briggs, London, England

[73] Assignee: Berger-Jenson & Nicholson, Ltd., London, England

[22] Filed: June 18, 1974

[21] Appl. No.: 480,355

[30] Foreign Application Priority Data

June 22, 1973 United Kingdom ..... 29650/73

[52] U.S. Cl. ..... 259/58; 222/409

[51] Int. Cl.[2] ..... B01F 9/12

[58] Field of Search ..... 259/57, 58, 54, 82, 84, 259/85, 30, 31, 32, 49; 222/144, 409, 142

[56] References Cited

UNITED STATES PATENTS

| | | | |
|---|---|---|---|
| 2,423,969 | 7/1947 | Foltz | 259/58 |
| 2,526,351 | 10/1950 | Grubelic | 259/58 |
| 3,199,775 | 8/1965 | Drucker | 259/57 |
| 3,559,960 | 2/1971 | Elder | 259/58 |

*Primary Examiner*—Robert W. Jenkins
*Attorney, Agent, or Firm*—William Anthony Drucker

[57] ABSTRACT

An agitating apparatus comprising a support, a container supported by the support and rotatable relative to the support about a substantially vertical axis, an agitator within the container and co-operating drive means between the support and the upper part of the container for driving said agitator when the container is rotated about said axis.

3 Claims, 2 Drawing Figures

AGITATING APPARATUS

Figure 1:
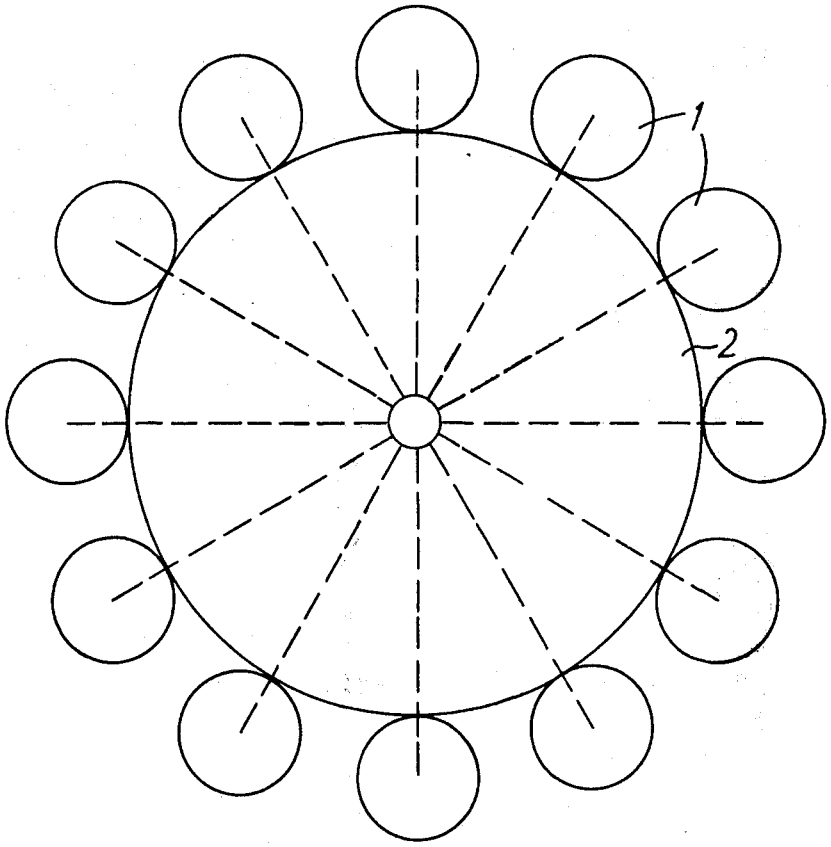

The present invention relates to agitating apparatus and more particularly, but not solely, to apparatus for use in agitating and dispensing paint colourants.

In British Patent Specifications Nos. 1021676 and 1021677 there is described and shown a paint colourant dispensing and mixing machine in which a plurality of canisters are arranged around and supported by a rotatable carrier plate. The carrier plate can be rotated by means of a wheel and handle which is connected by means of a shaft and bevel gears to a friction roller which engages the underside of the periphery of the rotatable carrier plate. A drive transmission device having a pulley is located at the top of each canister and all the pulleys are driven by a common drive belt from a central driving pulley which is connected to an electric motor arranged beneath the carrier plate. Thus in order to rotate stirrers in the canisters it is necessary to switch on the electric motor whereas to bring a canister to a described dispensing position it is necessary to operate manually the wheel and handle. Furthermore in order to fill a canister it is necessary to pivot its respective drive transmission device away from the lid of the canister before the lid can be removed.

According to the present invention there is provided an agitating apparatus comprising a support, a container supported by the support and rotatable relative to the support about a substantially vertical axis, an agitator within the container and co-operating drive means between the support and the upper part of the container for driving said agitator when the container is rotated about said axis.

In one preferred embodiment of the present invention there is provided a support structure, a plurality of containers mounted around the structure and rotatable therearound about a vertical axis, a stirring device in each container, a drive transmission device located at or near the top of each container for operating the stirring device in the respective container, and a drive device supported by the support structure, the drive device being connected to each drive transmission device so that when the containers are rotated about said vertical axis the drive device drives the stirring devices through the drive transmission devices.

The containers may be rotated about the vertical axis manually or, if desired mechanical and/or electrical rotating means may be provided.

The drive device is preferably a central gear wheel and each drive transmission device is preferably a toothed gear provided around the top of its container and meshing with the central gear wheel. As the containers are rotated about the vertical axis the toothed gears are rotated as planet wheels with the central gear wheel acting as sun wheel.

Alternatively the drive device may comprise a flexible belt stretched around a central circular member. The drive device may also comprise a driving belt or chain for driving toothed gears on the containers.

Each agitator or stirring device may comprise a stirrer rotatably supported in bearings at the top and bottom of the container.

Each container may be provided with means for dispensing liquid from the container. The means for dispensing a liquid may comprise a valve and piston assembly. The piston may be slidably mounted in a calibrated housing or the piston movement may be controlled so that the amount of liquid dispensed can be predetermined.

The apparatus may be used for mixing paints. In this case each of the containers contain a paint pigment, i.e. colouring liquid. A container of basic paint is obtained and placed in front of the apparatus. The containers of the apparatus are rotated until the container with the required paint pigment is adjacent the container of basic paint. A predetermined quantity of paint pigment is then dispensed into the basic paint. In rotating the containers the paint pigment in each dispenser is automatically stirred.

Basic paint is not necessarily limited to white paint but means in general the basic colour employed for colour matching.

Figure 2:
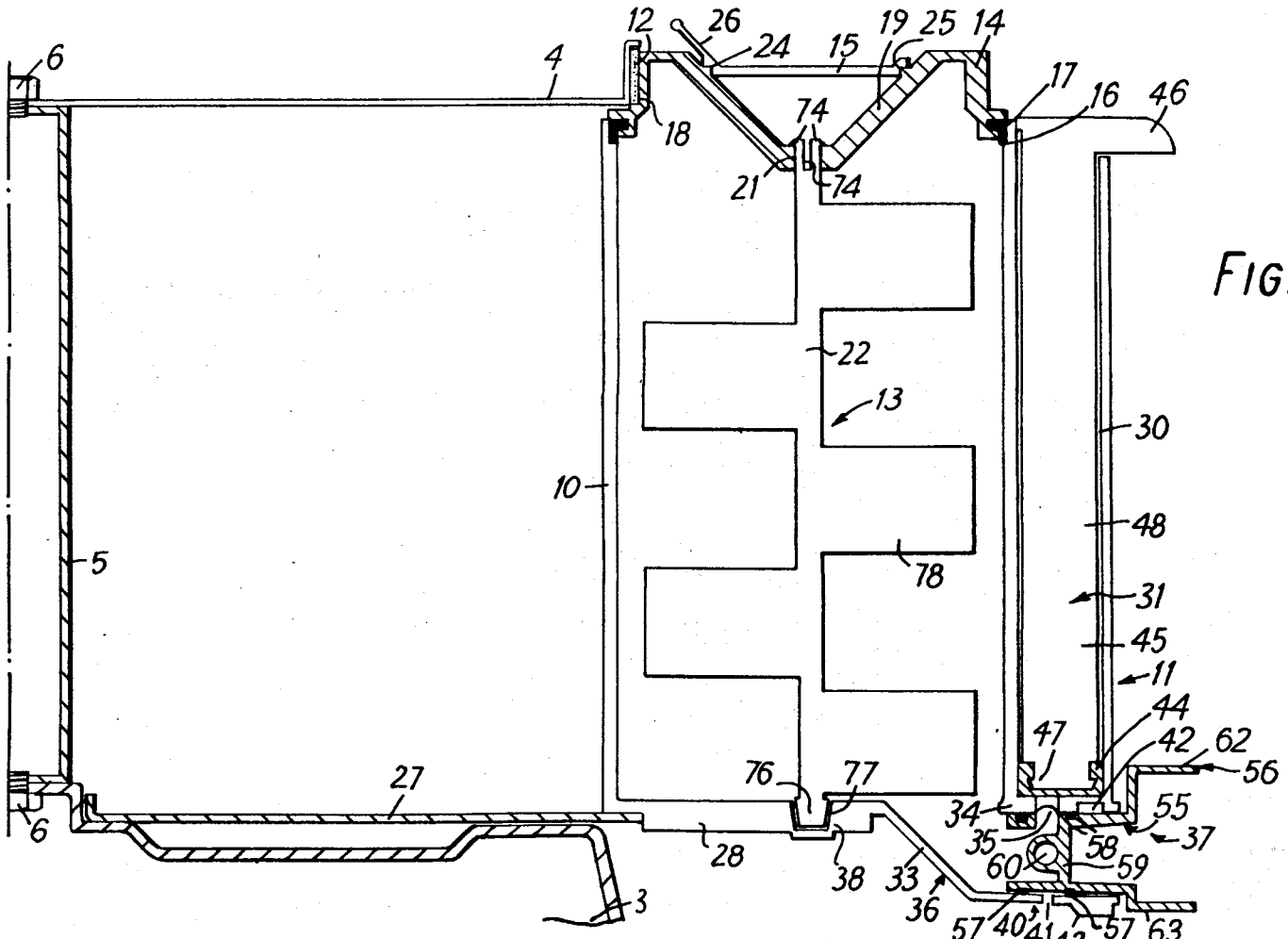

A constructional embodiment of the present invention will now be described, by way of example, with reference to the accompanying drawings, wherein:

FIG. 1 shows a diagrammatical plan view of paint agitating apparatus according to the present invention; and FIG. 2 is a cross sectional elevation through the centre of one half of the apparatus according to the present invention and one container.

FIG. 1 shows the general arrangement of an apparatus for use in mixing paints. The apparatus is shown to comprise a plurality of containers 1 arranged around and supported by a support structure 2. In the examples shown there are 12 containers 1 which are arranged so as to be rotatable around the structure 2. Adjacent containers may inter-lock with each other to form a drum and may be provided with considerable cladding for aesthetic reasons.

As shown in FIG. 2 the support structure comprises a moulded base 3 and a disc or ring 4 with a spacer 5 arranged therebetween. The base 3 and disc 4 are attached to the spacer by bolts 6.

Each container comprises a housing 10 having a bearing for supporting a stirrer or paddle 13 the upper end of which is supported by a cylindrical member 14 which is rotatably mounted on the container and has an external gearing 12 and a cover 15. Each container is provided with a dispenser 11.

The upper end of the housing 10 has a recess 16 in its internal surface. This recess 16 accommodates a mounting ring 17 with a bearing onto which the member 14 is fitted. The member 14 is of cylindrical form and is provided with a recess 18 in its outer surface into which the gearing 12 is fitted. The gear 12 is integrally formed with the member 14. The member 14 has a vane or web 19 which is provided with a square-shaped aperture through which a portion 21 of the stirrer stem 22 passes. A flange is provided on the underside of the web 19. To facilitate attachment of the cover 15 the inner surface of the member 14 is provided with an inner circular ledge 24. The cover 15 has a recess or projections 25 and the ledge 24 engages in the cover recesses or the cover rests by its projections on the ledge 24 when it is placed on the member 14. The cover 15 has a handle 26 to facilitate removal of the cover.

The base 28 of each container is attached to a platform 27 which is mounted to be rotatable about a central vertical axis passing through the spacer 5 and base 3.

Each dispenser comprises a housing 30 which may be integrally moulded with its housing 10. Each housing 30 contains a piston assembly 31. The housing 30 is of cylindrical form and a portion of the housing 30 forms a part of the housing 10. The housing 30 extends substantially the whole length of the housing 10, support ribs interconnect the housing 30 with other parts of the housing 10. The ribs are integrally formed with the housing 30 and the housing 10. A base 34 provided in the housing 30 has an aperture 35 which provides a flow path for liquid between housings 10 and 30.

The base 28 of the housing 10 has a projection indicated generally by the reference numeral 36 extending downwardly therefrom, the projection being shaped so as to accommodate a valve 37. The projection 36 consists of a first portion 33 depending from a horizontally disposed portion 38 of the base and a second portion substantially horizontally disposed. The second portion is situated beneath the base 34 of the housing 30 so as to form therewith a housing 40 for the valve 37. The housing 40 tapers by an angle of 2°, its narrower end, being the end nearest the centre of the dispenser. The housing 40 has an aperture 41 whose longitudinal axis is in alignment with the longitudinal axis of the aperture 35 which is in the base 34 of the housing 30. The base 34 which is a portion of the housing 30 for the piston assembly 31 also forms a portion of the housing 40 for the valve 37. In the internal surface of the housing 40 there is provided a slot 42 and the external surface has a reinforcing rib 43.

The piston assembly 31 comprises a piston 44, a stem 45 and a head section 46. The piston assembly 31 is slidably mounted in the housing 30. The stem 45 is provided with an end portion 47 which is embedded in the piston 44. Alternatively the piston may comprise a pair of O-rings mounted on the end of the stem 45. The piston 44 is dimensioned such that it fits inside the housing 30 in a seal tight manner.

The valve 37 comprises two integrally formed portions 55 and 56. The portion 55 is substantially in the form of an hollow cylinder and is tapered. The taper is through an angle of 2° to the horizontal and the narrower end is the end remote from the portion 56. The portion 55 is thus suitably shaped to fit into the housing 40. The portion 55 has recesses 57 in its outer surface which accommodate 0 seals 58.

The valve 37, when fitted into the housing, is rotatable with respect to the housing. The portion 55 has an intermediate part 59 which has an aperture 60 transverse to the longitudinal axis of the valve. By turning the valve, when mounted in the housing 40, through an angle of 90° from the position shown in FIG. 2, the aperture 60 can be brought into alignment with the apertures 35 and 41. The outer surface of the portion 55 has a projection 61 which engages in the slot 42 when the valve is mounted in the housing 40. The rotational movement of the valve can thus be limited by the amount of movement of the projection in the slot. The portion 56 of the valve, when viewed in end elevation is substantially oval-shaped and this portion is hollow like the portion 55.

The valve 37 is shaped or provided with markings so that it is possible and obvious to the user.

The operation of dispensing liquid from the apparatus will now be described. First the valve 37 is checked to see that its end 62 is uppermost, i.e. the position shown in FIG. 2. The piston 44 is then moved upwards within the housing 30. A low pressure region is created below the piston 44 in the housing 30 and as a result liquid will flow out of the housing 30 through channel 35. The valve 37 is then turned through 90° from the position shown in FIG. 2 thereby bringing aperture 60 into alignment with the apertures 35 and 41. Liquid may then be dispensed from the housing 30 through aperture 35, aperture 60 and aperture 41 by depressing the piston 44 down to the base of the housing 30 to ensure that all the liquid that has entered the housing is dispensed. In operations where the amount of fluid dispensed needs to be known, the housing 30 could be calibrated or the piston movement could be controlled so that the amount of liquid dispensed can be predetermined.

The arrangement for rotating the stirrers will now be described. The periphery of the disc or ring 4 comprises a gear wheel which meshes with the gearings 12 on the containers. Thus when the platform 27 is rotated to bring the container with the selected paint pigment into the correct position for dispensing the gearings 12, members 14 and stirrers 13 will rotate. The result is that, each time the platform 27 is rotated the liquid in the containers is stirred.

The upper end portion 21 of each stirrer stem 22 is square-shaped and is suitably dimensioned to fit within the aperture 20 of the web 19. The end portion 21 has a slot 74. Flanges 75 are also provided in the end portion 21, the flanges engage with the upper surface of the web 19 when the stirrer 13 is fitted to the web. The lower end portion 76 of the stem is preferably an inverted frust-conical shape, the conical surface of which is inclined at, for example, 10° to the vertical. When the stirrer 13 is fitted in the container, the end portion 76 engages in a recess 77 provided in the base 28 of the container, the recess 77 being of a similar shape to the end portion 76. The stirrer 13 is provided with preferably rectangular shaped leaves 78 each leaf 78 being attached to the stem 22 so that it is disposed at an angle of 45° to the horizontal.

It should be noted that in order to fill the containers it is only necessary to raise their covers 15 by means of handles 26. The gearings 12 can remain in engagement with disc 4 so that it is not necessary to disconnect the drive transmission devices in order to fill the containers.

I claim:

1. An apparatus for mixing and dispensing liquids comprising a central support structure, a support member rotatably mounted on said support structure, a plurality of dispensing containers mounted on said support member and fixed relative thereto, a drive member mounted on the support structure and fixed relative thereto, a drive transmission device located adjacent the upper end of each container and rotatably mounted thereon, each of said drive transmission devices engaging said drive member, a stirring device depending from each drive transmission device into its associated container, and a removable closure member in each drive transmission device, wherein the apparatus is constructed and arranged so that when the support member is rotated each of the drive transmission and stirring devices is rotated by the drive member relative to the dispensing containers.

2. An apparatus as claimed in claim 1, in which the drive member comprises a central sun gear wheel and each drive transmission device comprises a planet gear forming the external surface of a cylindrical member and meshing with said sun gear.

3. An apparatus as claimed in claim 1, in which each container is provided with a dispenser for dispensing a predetermined quantity of liquid, each dispenser comprising an elongated housing, a piston axially movable in the housing an a valve movable from a first position in which it connects the container to the housing to a second position in which it connects the housing to an outlet.

* * * * *